US006550066B1

(12) United States Patent
Brassey

(10) Patent No.: US 6,550,066 B1
(45) Date of Patent: Apr. 22, 2003

(54) SPORTS JACKET OF REVERSIBLE CONSTRUCTION FOR DISPLAYING ALTERNATE TEAM AND/OR PLAYER AFFILIATIONS

(76) Inventor: Theresa Ann Brassey, 810 Fishback Rd., Manteca, CA (US) 95337

( * ) Notice: Subject to any disclaimer, the term of this patent is extended or adjusted under 35 U.S.C. 154(b) by 228 days.

(21) Appl. No.: 09/040,271

(22) Filed: Mar. 18, 1998

(51) Int. Cl.[7] ..... A41B 1/00
(52) U.S. Cl. ..... 2/93; 2/115; 2/85; 2/108
(58) Field of Search ..... 2/85, 93, 108, 2/DIG. 2, 115

(56) References Cited

U.S. PATENT DOCUMENTS 1,052,475 A * 2/1913 Friedman ..... 2/DIG. 2 X
1,371,841 A * 3/1921 Berkwits ..... 2/DIG. 2 X
2,711,539 A * 6/1955 Loscher ..... 2/93
5,029,344 A * 7/1991 Shannon et al. ..... 2/93

OTHER PUBLICATIONS

Eastbay Catalog—Spring 1996, p. 36, Pro Player Youth Home/Away Reversible Jackets.*

* cited by examiner

*Primary Examiner*—Gloria M. Hale
(74) *Attorney, Agent, or Firm*—John P. Halvonik

(57) ABSTRACT

A team jacket with sports logo that is of reversible construction. Different teams sports logos are on both the inner and outer surfaces of the jacket. The jacket may also be equipped with the names of players so that the jacket may be reversed to reveal a different player's name and/or number.

2 Claims, 2 Drawing Sheets

SPORTS JACKET OF REVERSIBLE CONSTRUCTION FOR DISPLAYING ALTERNATE TEAM AND/OR PLAYER AFFILIATIONS

BACKGROUND AND FIELD OF THE INVENTION

The invention relates to the field of jackets and sporting wear and, in particular, to a jacket that is of reversible construction and having different teams sports logos on both the inner and outer surfaces of the jacket in order to allow the display of alternate team logos. The jacket may also be equipped with the names of players so that the jacket may be reversed to reveal a different player's name or number.

The jacket is believed to have utility among those sports fans who find that teams are seemingly constantly switching city affiliations and those fans no longer have the same loyalties to those teams as they did in previous times. The same may be said for players as well because with the advent of free agency players are constantly moving from team to team.

The jacket is meant to be amusing or entertaining in that other sports fans who see the jacket on display will immediately grasp the intended pun or message when the user stands up and reverses his jacket in order to display a new team that he/she is now rooting for. The reversible jacket as described herein readily conveys the message that team sports loyalties among both fans and owners is very fickle and that one can change his team loyalty as easily as changing ones jacket.

Among the advantages of such a jacket is that the fan does not have to invest in two jackets in order to root for two teams or two players. One jacket having multiple logos will suffice. Also, the fan will not have to risk the approbation of other fans when he is in a different stadium. If that team that he is rooting for loses, the game or is otherwise unacceptable to the rest of the fans, e.g. for example if they are the visiting team, the user can simply reverse the jacket and present those fans in the stadium with a logo for a team and/or player that is acceptable to them.

PRIOR ART

While there are jackets that are reversible in nature, none that applicant is aware of have multiple team sports logos displayed on both the inner and the outer surfaces of the jacket. Nor are there any with multiple player names on them.

SUMMARY OF THE INVENTION

A sporting jacket having one team logo on the outside of the jacket and having a second team logo on the inside of the jacket. The jacket is of reversible construction so that the logo on the inner surface may be displayed upon reversing the jacket with the inner logo now appearing on the outer surface of the jacket. The second logo should be distinguishable from the first logo so that when the jacket is reversed a different logo can be displayed by the wearer.

It is an objective of the invention to provide a sports jackets having multiple team and/or player designations to allow sports fans to display an alternate team/player designation in the event that they wish to root for different teams and/or player.

Another objective of the invention is to provide an amusing message to fans and others whereby the owner of a sports jacket can convey the message of changing team loyalties by simply reversing his/her jacket.

Other advantages will become known to those skilled in the art once the invention is shown and described.

DESCRIPTION OF THE PREFERRED EMBODIMENT

Figure 1:
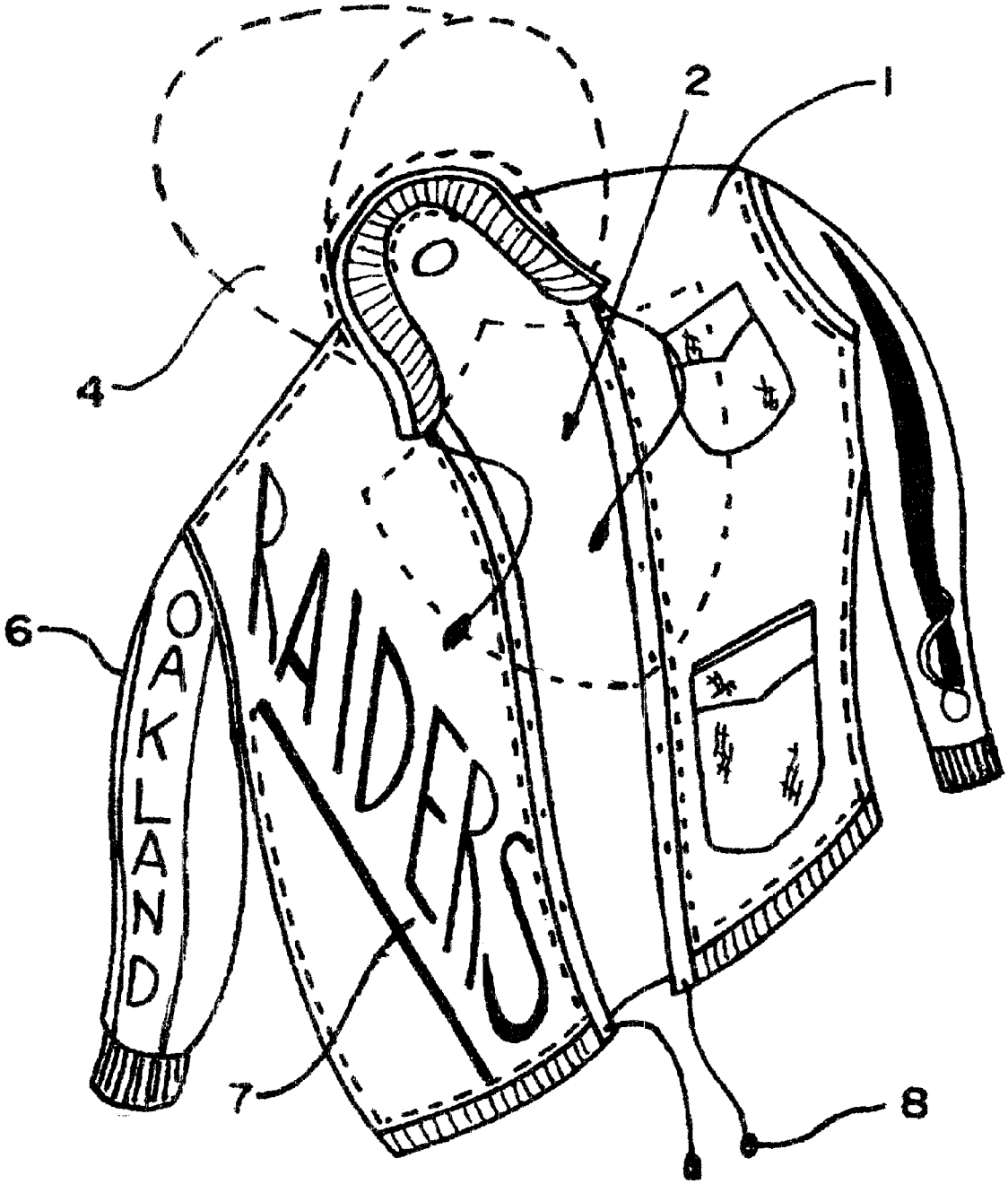
FIG. 1 Overall construction of apparatus.
Figure 2:
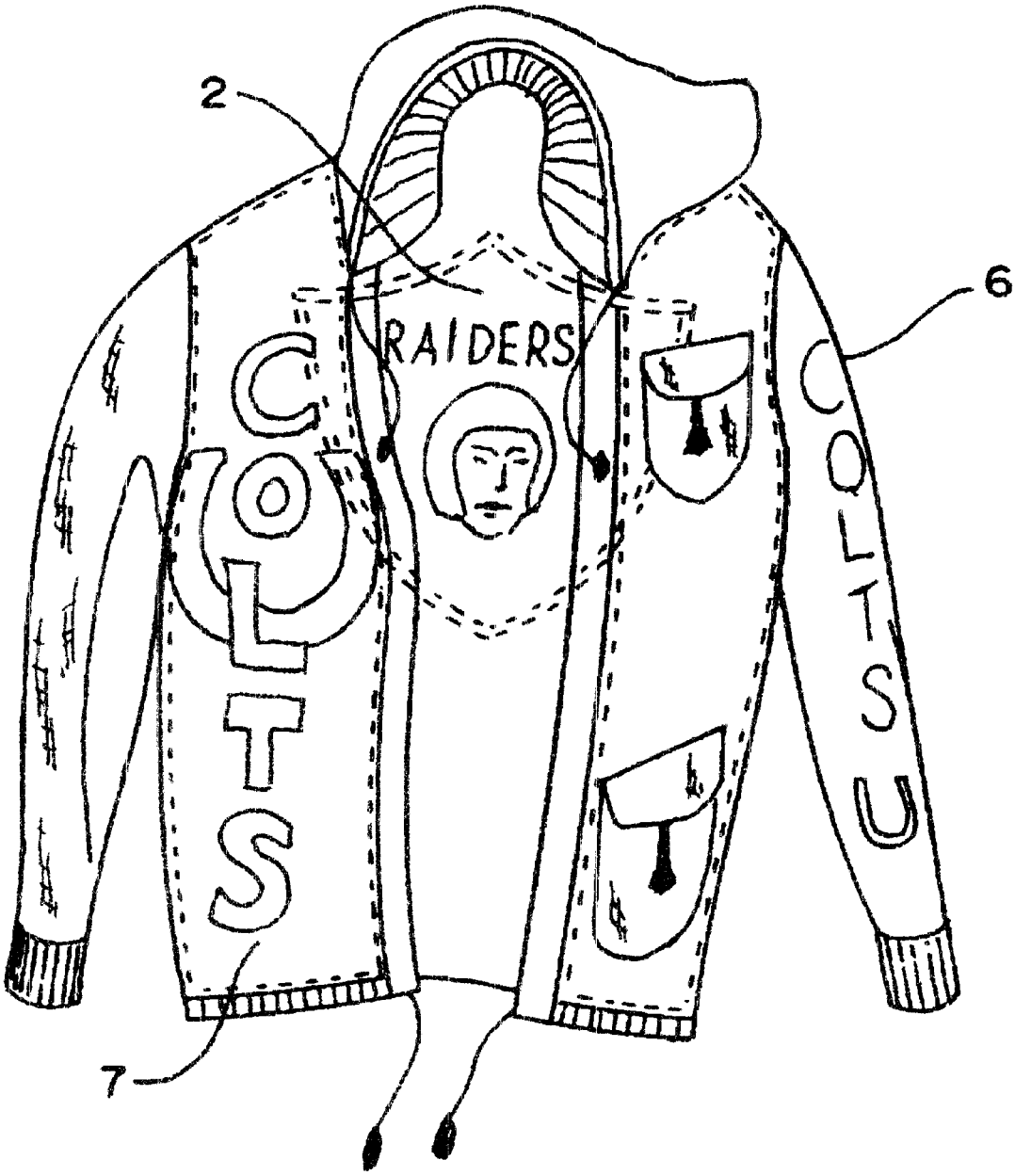
FIG. 2 perspective view.

The invention is shown in FIG. 1. The reversible jacket has a series of seams and various stitching so that the jacket maybe reversed in order to wear with the inner surface 2 facing outward. The jacket may be made of construction that is standard in the field. Use may be made of seams, stitching, liners, and other features that are often found in the manufacture of jackets.

The jacket is shown as 1 and preferably will have a team logo on the sleeve 6 or on the lapel area 7 of the jacket. A similar logo for a second team is shown on the inner surface at 2. Player names and numbers may be used just as well. This logo may be referred to as the second or inner logo. The second logo should be in that part of the jacket that is nearly opposite the first logo and on the other side of the jacket surface so that when the jacket is worn in reversed fashion, a new logo, different from that logo on the outside will appear in approximately the same place as the original logo when the jacket was worn in the original manner. The second logo should be on the inner surface of the jacket and may be on the lapel, the sleeve, the back or other area of the jacket when the jacket is reversed. The first logo may go on the outer surface of the jacket and in the same areas i.e. lapel, sleeve, back, etc. as the second logo.

Logos on both the inside and the outside of the jacket may be on different places on the jacket. For instance, team logos may be found on the breast pocket or on the back of the jacket. Those logos on the inside of the a jacket should be so placed so that they will show up in an appropriate place (such as breast pocket, back, etc.) when the jacket is reversed.

Instead of logos, a similar concept may be used for players' names and/or numbers. These may be displayed on one side of the jacket with an alternate name and/or number on the other side of the jacket. Of course, the player's name and/or number may be matched to the team colors or team uniform that may also form a part of the jacket colors/logos.

When the user decides that it is time to switch his team affiliation or player affiliation, he simply reverses the jacket and then displays the team logo of the new team or player that he will root for. The jacket may come with zippered hood and having an inner liner that may be removed as the weather dictates.

I claim:

1. A jacket of reversible construction and having an inner surface and an outer surface, each of said inner and outer surface having visible indicia so as to identify a sports team, said visible indicia on said inner surface being of a different team affiliation than said visible indicia on said outer surface.

2. A jacket of reversible construction and having an inner surface and an outer surface, each of said inner and outer surface having visible indicia so as to identify a sports player, said visible indicia on said inner surface being of a different player than said visible indicia on said outer surface.

* * * * *